US007298274B2

(12) United States Patent
Chen et al.

(10) Patent No.: US 7,298,274 B2
(45) Date of Patent: Nov. 20, 2007

(54) PASSIVE RFID-BASED ELECTRONIC SEAL

(75) Inventors: Shu-Mei Chen, Xinzhuang (TW); Shu-Hui Hsu, Richardson, TX (US)

(73) Assignee: Pretide Holdings, Inc., Tortola (VG)

( * ) Notice: Subject to any disclaimer, the term of this patent is extended or adjusted under 35 U.S.C. 154(b) by 264 days.

(21) Appl. No.: 11/211,627

(22) Filed: Aug. 26, 2005

(65) Prior Publication Data

US 2006/0145868 A1 Jul. 6, 2006

(30) Foreign Application Priority Data

Dec. 24, 2004 (TW) ..... 93220859 U

(51) Int. Cl.
*G08B 13/14* (2006.01)

(52) U.S. Cl. ..... 340/572.8; 340/572.1; 340/572.7; 29/282

(58) Field of Classification Search ..... 340/572.8, 340/572.3, 572.1, 572.7, 571; 29/592, 592.1, 29/282; 343/700 R
See application file for complete search history.

(56) References Cited

U.S. PATENT DOCUMENTS 7,215,250 B2 * 5/2007 Hansen et al. ..... 340/572.9
7,230,539 B2 * 6/2007 Klein ..... 340/573.3

* cited by examiner

*Primary Examiner*—Davetta W. Goins

(57) ABSTRACT

A passive RFID-based electronic seal having a lower body and an upper body, includes an upper, a central and a lower sleeve, two antennas, an RFID Chip, two sockets. When the first antenna of the upper body is inserted through a seal sleeve of the central sleeve of the lower body, a pawl suitably is placed at a middle of the first antenna gets stuck inside a pawl ring of the central sleeve of the lower body when passing through it and thus activates and completes the passive RFID-based electronic seal.

7 Claims, 6 Drawing Sheets

PASSIVE RFID-BASED ELECTRONIC SEAL

BACKGROUND OF THE INVENTION

1. Field of the Invention

The present invention relates to a passive RFID-based electronic seal using RFID (Radio Frequency Identification) technology to secure and to identify containers or other objects.

2. Description of the Prior Art

Nowadays in global container transportation, in order to easily identify the container and its cargo, and to keep the cargo from being stolen or being exchanged with something else, two kinds of seals, namely mechanical container seal and active type RFID-based electronic seal, are being used, wherein:

1. Mechanical container seal: Presently mechanical container seals are applied to most containers. When the container is sealed up, it is not possible to break in the container unless using clipper to destroy the seal. Moreover, every seal contains a serial number corresponding to a specific container; when passing through customs, an inspector will check visually if the seal is destroyed, if so, then the container has been broken in. However, it is easy to counterfeit the mechanical container seal and the serial number and tends to undermine the security of the container.

2. Active type RFID-based electronic seal: some containers use active type RFID-based electronic seals to avoid being forged and to provide better security. However, active type electronic seals are more expensive and their costs are a hundred times higher than those of mechanical container seals. Besides, high recycle costs related to electronic seals are also obstacles to widespread application.

Therefore, the two devices mentioned above present several shortcomings to be overcome.

In view of the above-described deficiency of prior-art seals, after years of constant effort in research, the inventor of this invention has consequently developed and proposed a passive RFID-based electronic seal.

SUMMARY OF THE INVENTION

The present invention is to provide an electronic seal using passive type RFID chip to provide better protection in transportation due to the uniqueness and authenticity of RFID chip code, compared to the mechanical container seal. Also, the cost of passive type RFID chip is cheaper than that of active type RFID-based electronic seal, with no recycle cost. Therefore, it is advantageous to transportation service providers.

Another, the present invention is to provide a RFID chip working with mechanically separated antenna to activate the RFID chip. When passing through a checkpoint, inspector can read the data inside the RFID chip using external device to check if the container has been broken in. Therefore, the passive RFID-based electronic seal is able to identify the container and other components to improve security and convenience during transportation.

Still another, the present invention is to provide a simple-structure, low-cost and easy to operate passive RFID-based electronic seal.

The passive RFID-based electronic seal disclosed herein has a lower body and an upper body, consisting of an upper, a central and a lower sleeve, two antennas, a RFID Chip, two sockets, a guide pin, a pawl ring and a seal sleeve. The lower sleeve has a slot placed within and a first inner screw thread placed at a front end of the slot, and a first spring, a retaining block and a first antenna installed sequentially. The first antenna is held against the retaining block to move back and forth inside the lower sleeve. The central sleeve has a step-like hole passing through it and a second inner screw thread placed at a front end of the central sleeve. A first outer screw thread is placed at a rear end of the central sleeve. A retaining plate, a second spring and a push ring are placed inside the central sleeve sequentially. The RFID chip has its two ends attached to a socket and placed inside the central sleeve, then a pipe placed at a rear end of the socket and a third spring and a first push tube placed sequentially inside the pipe, a guide pin passing through the middle of the first push tube and a retaining ring and a pawl ring placed at a front end of the guide pin. When every component mentioned above is placed in the step-like hole of the central sleeve, it is to screw the first outer screw thread at a rear end of the central sleeve to the first inner screw thread at a front end of the lower sleeve to form the lower body. The upper body comprises a seal pipe placed at a front end of the upper sleeve and a push tube inside the upper sleeve with a second antenna inserted therein, a pawl suitably placed at a middle of the second antenna. The the passive RFID-based electronic seal will not activate until the upper body and the lower body are combined together.

Finally, inserting the second antenna of the upper sleeve through the hole of the central sleeve inside the lower body, when the pawl of the second antenna passing through the pawl ring, the upper sleeve and second antenna firmly gets stuck in the central sleeve for an aperture of the pawl ring being smaller than that of the pawl of the second antenna and held against a rear end of the seal sleeve from being pulled out. Transportation service providers can utilize the RFID chip technique and the structure disclosed in present invention to secure and to identify containers or other objects. Before passing through customs, inspector can read the data inside the RFID chip using external device to check if the container has been broken in. If the container has been broken in, then no data will be retrieved; on the other hand, if the data of the container can be obtained, then the container is allowed to pass through quickly. In this way, the proposed invention will improve the security and convenience in shipping the container and thus will be advantageous to transportation service providers.

The features and advantages of the present invention will be fully understood and appreciated from the following detailed description of the accompanying drawings.

DETAILED DESCRIPTION OF THE PREFERRED EMBODIMENT

Figure 1:
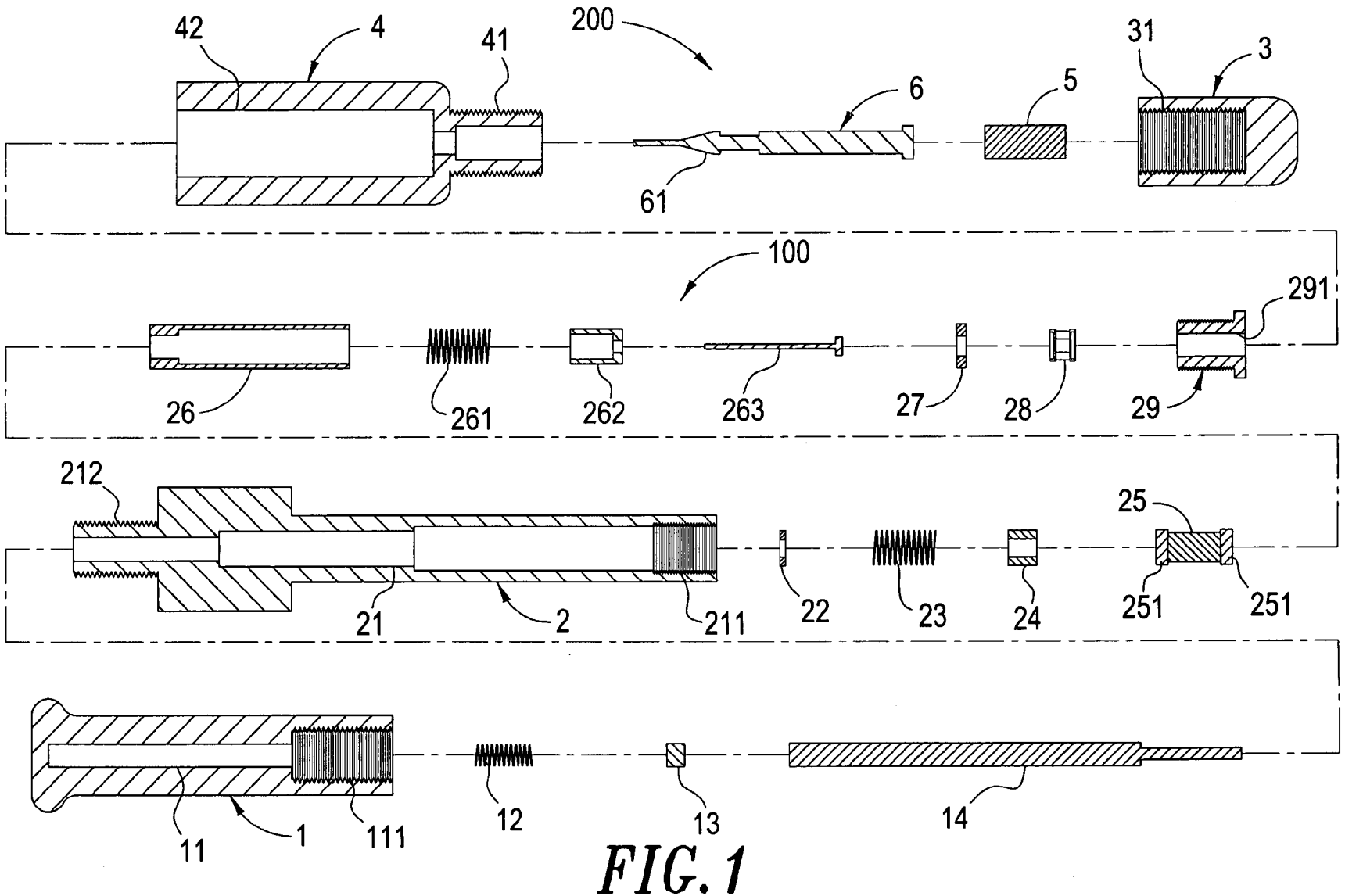
FIG. 1 schematically illustrates a top decomposition view of the passive RFID-based electronic seal in the present invention.
Figure 2:
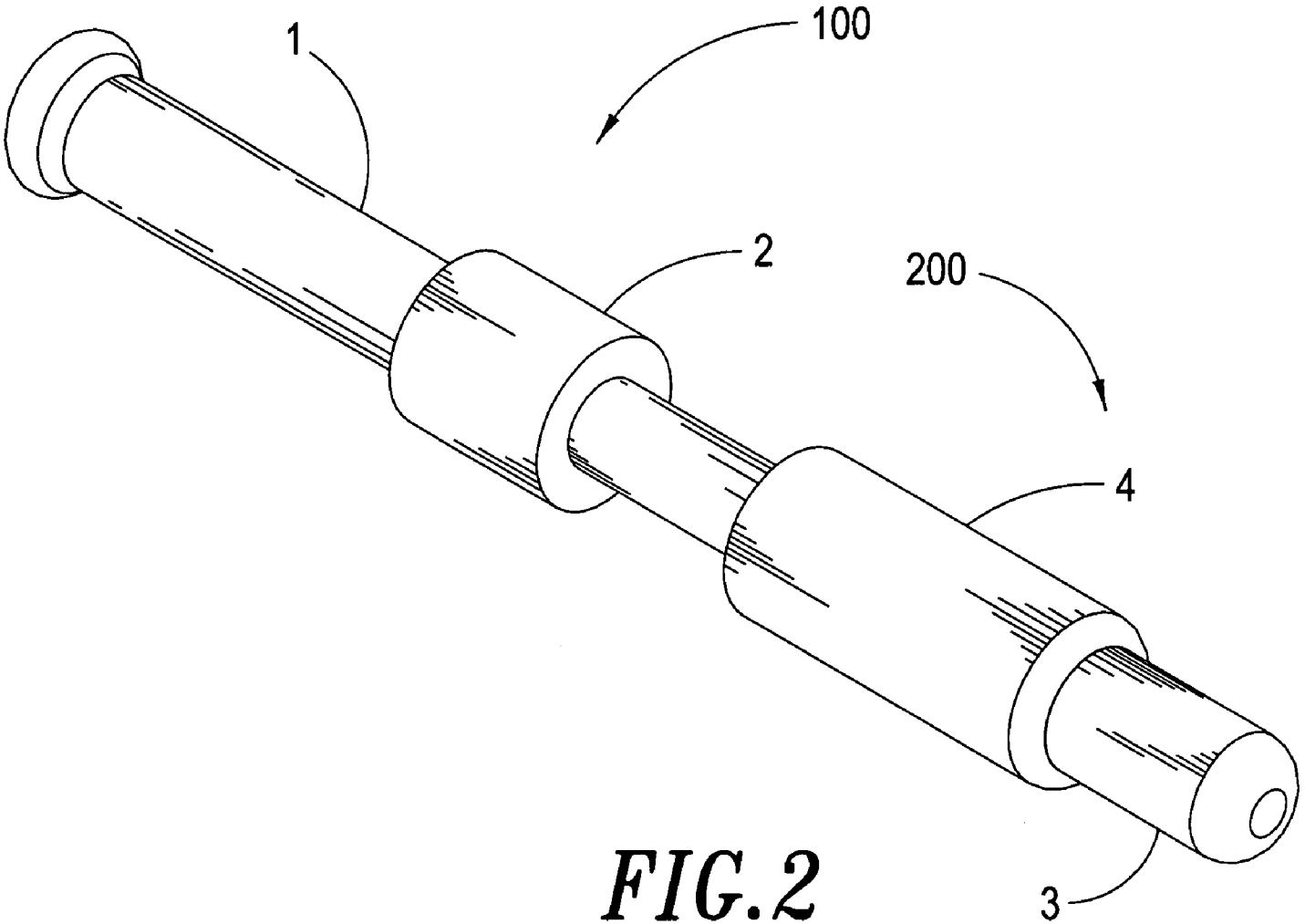
FIG. 2 schematically illustrates an integrated view of the passive RFID-based electronic seal in the present invention.

FIG. 1 and FIG. 2 schematically illustrate a top decomposition view and an integrated view of the passive RFID-based electronic seal in the present invention respectively. The passive RFID-based electronic seal comprises a lower body 100 including a lower sleeve 1 and a central sleeve 2.

The lower sleeve 1 has a slot 11 placed within and a inner screw thread 111 placed at a front end of slot 11, and a spring 12, a retaining block 13 and a 14 antenna placed sequentially. The antenna 14 is held against retaining block 13 to move back and forth inside the slot 11 of lower sleeve 1. The antenna 14 provides transmission/reception of radio waves.

The central sleeve 2 has a step-like hole 21 passing through it and an inner screw thread 211 placed at a front end of central sleeve 2. An outer screw thread 212 is placed at a rear end of central sleeve 2, and a retaining plate 22, a spring 23 and a push ring 24 placed inside central sleeve 2 sequentially. A RFID chip 25 has its two ends attached to a socket 251 and placed inside central sleeve 2, then a pipe 26 is placed at a front end of socket 251 and a spring 261 and a push tube 262 placed sequentially inside pipe 26. A guide pin 263 passes through the middle of push tube 262 and a retaining ring 27 and a pawl ring 28 is placed at a front end of guide pin 263. When every component mentioned above is placed in the step-like hole 21 of central sleeve 2, springs 23, 261 inside central sleeve 2 lets every component in hole 21 of central sleeve 2 to move back and forth, then a seal sleeve 29 screws to inner screw thread 211 of a front end of central sleeve 2 to prevent every component in central sleeve 2 breaking away from the front end of central sleeve 2. A hole 291 is placed in the middle of seal sleeve 29 passing through it. Finally, it is to screw outer screw thread 212 at a rear end of central sleeve 2 to inner screw thread 111 to form the lower body 100. The RFID chip 25 records data, responds to query, encodes data during transmission and provides digital/analog data conversion. The socket 251 connects RFID chip is for turning on RFID chip;

An upper body 200 comprises a seal pipe 3, an upper sleeve 4, a push block 5 and an antenna 6. The seal pipe 3 has an inner screw thread 31 placed within. The upper sleeve 4 has an outer screw thread 41 placed at a front end of it. A step-like hole 42 passes through upper sleeve 4, then antenna 6 is inserted into hole 42 and sealed at the front end of upper sleeve 4. Push block 5 is placed inside hole 42 and placed in front of antenna 6. Screwing the outer screw thread 41 of upper sleeve 4 to inner screw thread 31 of seal pipe 3 is to prevent antenna 6 and push block 5 from separating apart from each other and to form upper body 200. A cone-like pawl 61 is suitably placed at a middle of antenna 6. The antenna 6 of the upper sleeve 4 inserts through hole 291 of central sleeve 29 inside lower body 100. When pawl 61 of antenna 6 passes through pawl ring 28, upper sleeve 4 and antenna 6 firmly got stuck in central sleeve 2 for an aperture of pawl ring 28 being smaller than that of pawl 61 of antenna 6, and held against a rear end of seal sleeve 29 from being pulled out. The antenna 6 provides transmission/reception of radio waves.

Figure 3A:
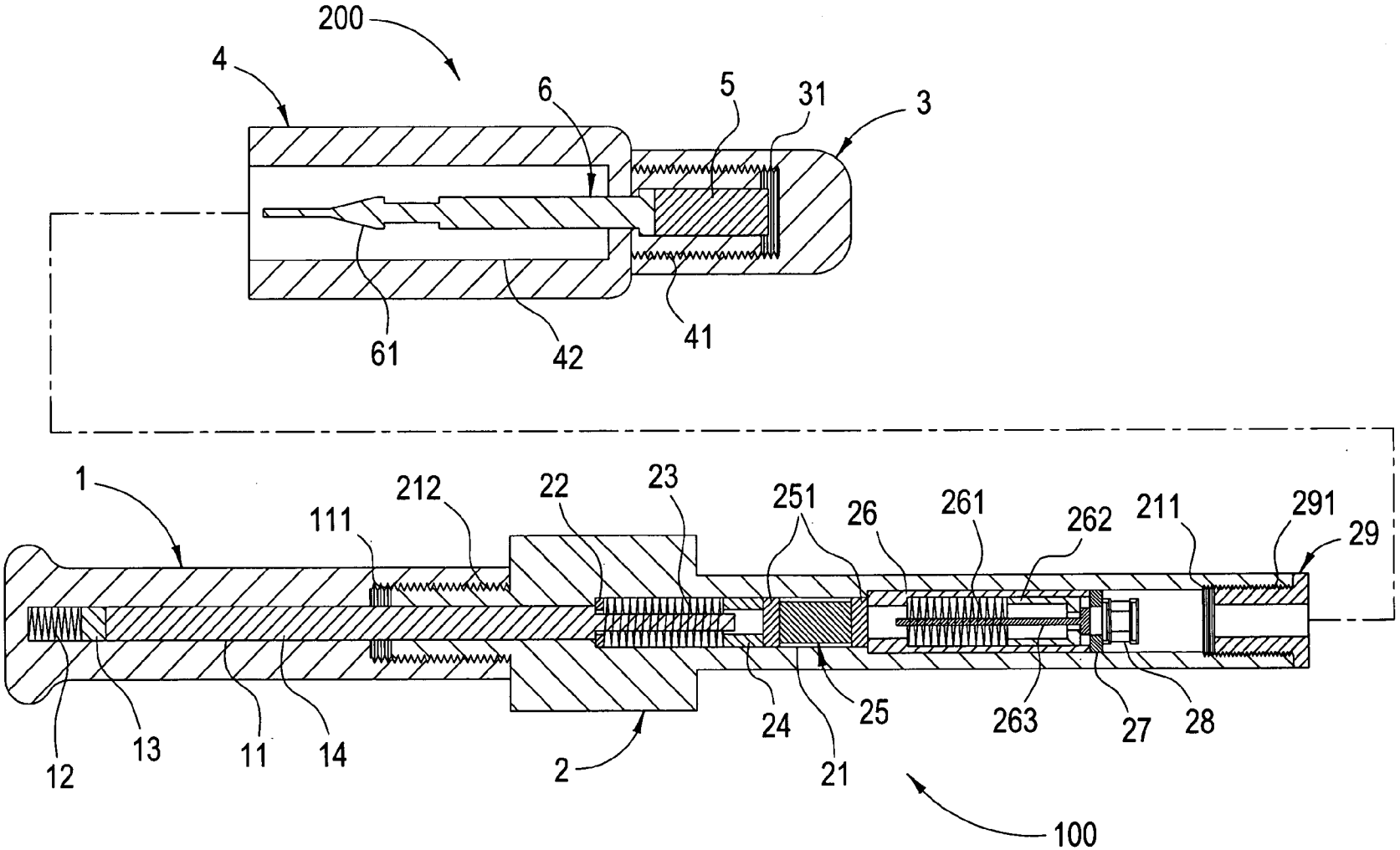
FIG. 3A, 3B, 3C schematically illustrate the operation of the passive RFID-based electronic seal.
Figure 3B:
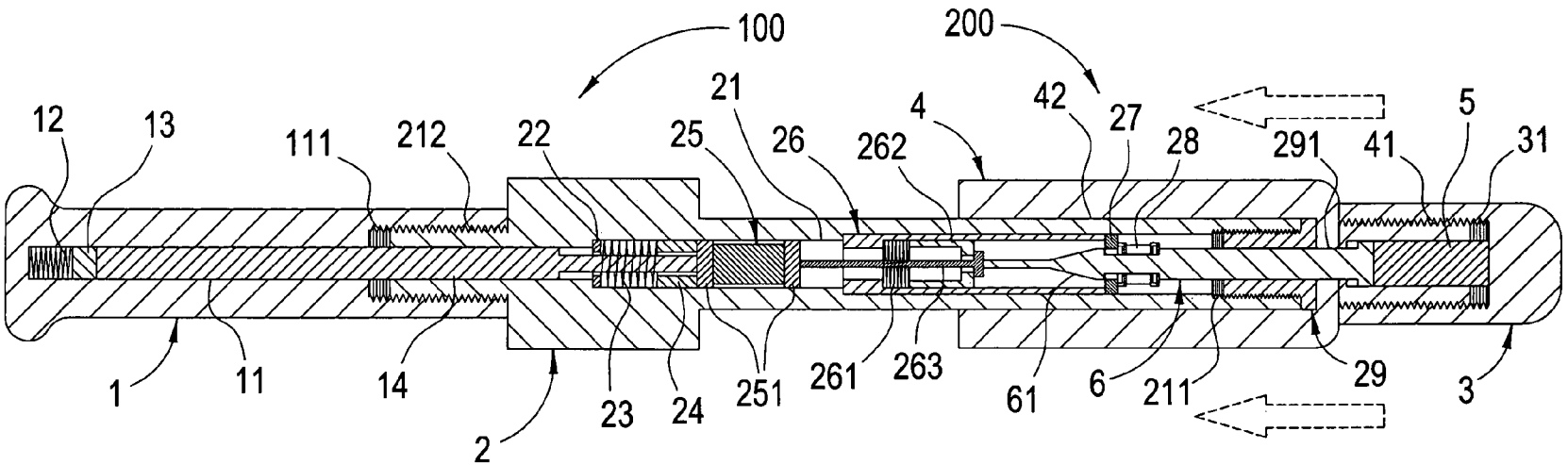
Figure 3C:
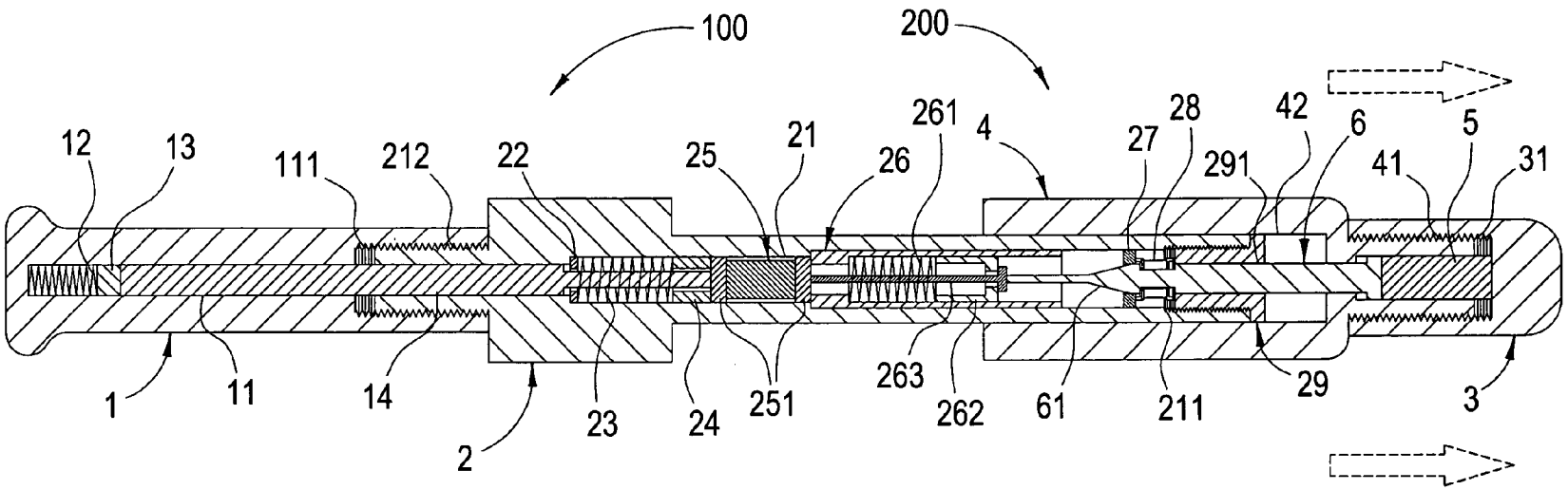

FIG. 3A, 3B, 3C schematically illustrate the operation of the passive RFID-based electronic seal. Firstly assemble the upper, central and lower sleeve 4, 2, 1 respectively, then interlock central and lower sleeve together to form lower body 100 (as illustrated in FIG. 3A). Then combine seal pipe 3, upper sleeve 4, push block 5 and antenna 6 to form upper body 200, and to insert the tip of antenna 6 of upper body 200 into the hole 291 of seal sleeve 29 in front of central sleeve 2 of the lower body 100. At this moment, antenna 6 pushes guide pin 263 to slide backwards and to let guide pin 263 to contact with socket 251 of RFID chip 25. For an aperture of pawl ring 28 being smaller than that of pawl 61 of antenna 6, upper sleeve 4 and antenna 6 firmly gets stuck in central sleeve 2 and held against a rear end of seal sleeve 29 from being pulled out. When antenna 6 of upper body 200 inserts deep further, it will push every components in central and lower sleeve 2, 1 simultaneously, and springs 12, 23, 261 of central and lower sleeve 2, 1 will be squeezed as well, and antenna 14 of lower sleeve 1 will make contact with another socket 251 of RFID chip 25 (as illustrated in FIG. 3B). Finally, when antenna 14, 6 of upper sleeve 4 and lower sleeve 1 both connect to socket 251 and turn on the RFID chip, no further insertion movement will be asserted. Meanwhile every component of upper, central and lower sleeve 4, 2, 1 will return to its original position due to the restoring force of springs 12, 23, 261.

Figure 4:
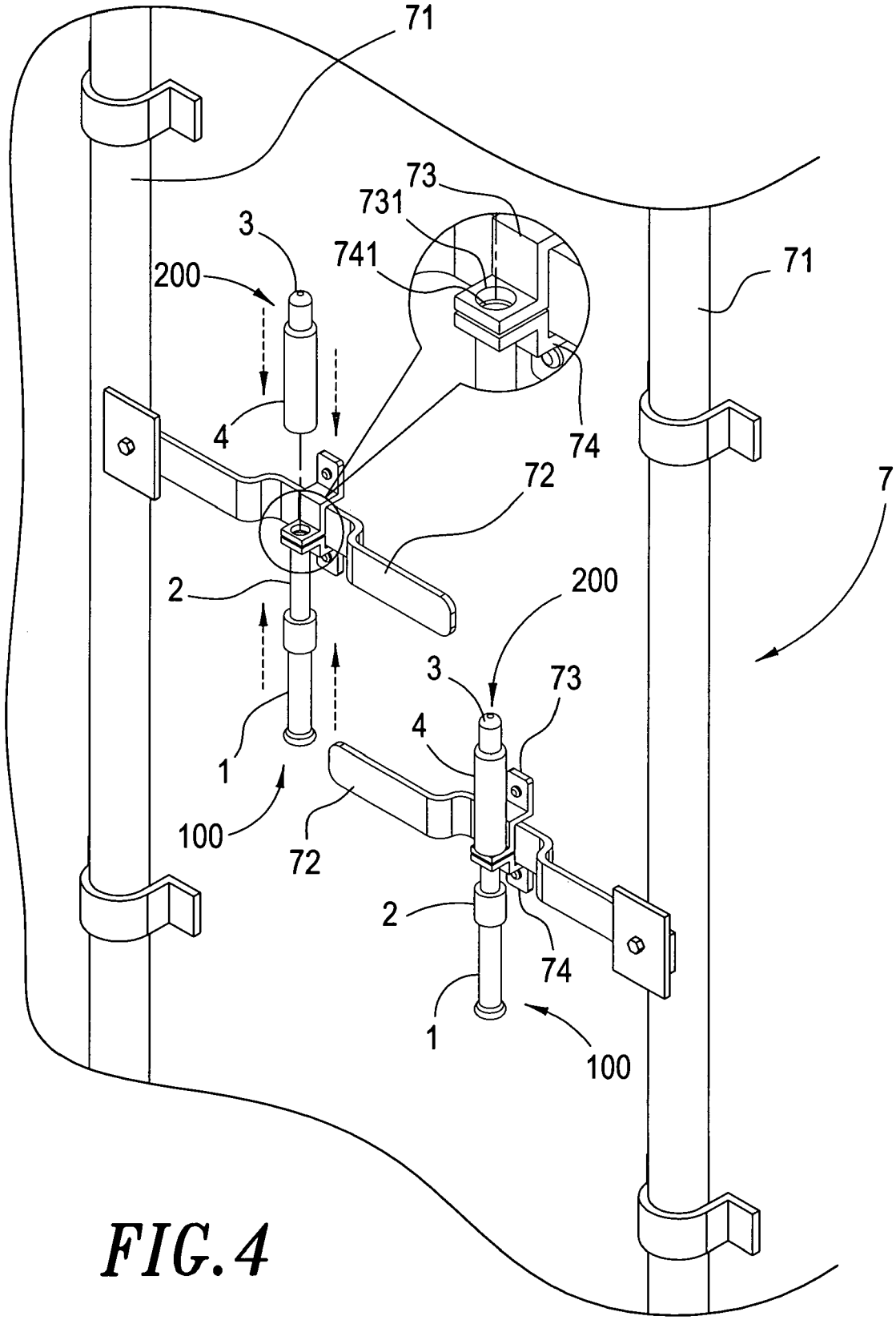
FIG. 4 schematically illustrates an implementation of the passive RFID-based electronic seal.

FIG. 4 schematically illustrates an implementation of the passive RFID-based electronic seal. The present invention uses container 7 as an example. When the fastener plate 72 of bolt body 71 of the container 7 is placed on a first and second locking member of container with locking holes 731, 741 placed within. At this moment, place lower body 100 consisted of central and lower sleeve 2, 1 under the lower end of locking hole 741 of the second locking member; guide upper body 200 through locking hole 731 of first locking member 73 and locking hole 741 of the second locking member to combine upper sleeve 4 of upper body 200 with central and lower sleeve 2, 1 of lower body 100 to become one unit and finish the locking movement. In the meantime, socket 25 of the electronic seal becomes operable. Inspector can utilize the technique of RFID chip 25 and the structure disclosed in present invention to identify if the container 7 has been broken in before passing through customs. If the container has been broken in, then no data can be retrieved and it can be judged that the container has been broken in.

The advantages of the passive RFID-based electronic seal disclosed in the present invention are:

1. The present invention provides a passive RFID-based electronic seal using passive type RFID chip to provide better protection in transportation due to the uniqueness and authenticity of RFID chip code, compared to the mechanical container seal. Also, the cost of passive type RFID chip is cheaper than that of active type RFID-based electronic seal, with no recycle cost. Therefore, it is advantageous to transportation service providers.

2. The present invention provides an RFID chip working with mechanically separated antenna to activate the RFID chip. When passing through a checkpoint, inspector can read the data inside the RFID chip using external reading device to check if the container has been broken in. Therefore, the passive RFID-based electronic seal is able to help make a container or other components more secure and convenient during transportation.

3. The present invention disclosed a simple-structure, low-cost and easy to operate passive RFID-based electronic seal.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A passive RFID-based electronic seal comprises:

a lower body, comprising:

a lower sleeve having a slot placed within and a first inner screw thread implemented at a front end of the slot, and a first spring, a retaining block and a first antenna placed sequentially; and a central sleeve having a step-like hole passing therethrough and a second inner screw thread placed at a front end of the central sleeve, and an first outer screw thread placed at a rear end of the central sleeve, and a retaining plate, a second spring and a push ring placed inside the central sleeve sequentially, a chip having two ends attached to a socket and placed inside the central sleeve, then a pipe placed at a front end of the socket and a third spring and a first push tube placed sequentially inside the pipe, a guide pin passing through the middle of the first push tube and a retaining ring and a pawl ring placed at a front end of the guide pin, when the central sleeve is assembled, springs inside the central sleeve let every component in the hole of the central sleeve to move back and forth, then a seal sleeve screw to the second inner screw thread of a front end of the central sleeve to avoid every component in the central sleeve breaking away from the central sleeve, a hole placed in the middle of the seal sleeve passing through it, finally, screwing the first outer screw thread at a rear end of the central sleeve to the first inner screw thread at a front end of the lower sleeve to form the lower body;

an upper body comprising a seal pipe having a third inner screw thread placed within, an upper sleeve, a push block and a second antenna, the upper sleeve having a second outer screw thread placed at a front end thereof, a step-like hole passing through the upper sleeve, then the second antenna being inserted into the hole and locked at the front end of the upper sleeve, the push block being placed inside the hole and placed in front of the second antenna, screwing the second outer screw thread of the upper sleeve to the third inner screw thread of the seal pipe to prevent the second antenna and the push block from separating apart and to form the upper body; a cone-like pawl suitably placed at a middle of the second antenna; the second antenna of the upper sleeve inserting through the hole of the central sleeve inside the lower body, when the pawl of the second antenna passing through the pawl ring, the upper sleeve and second antenna firmly got stuck in the central sleeve for an aperture of the pawl ring being smaller than that of the pawl of the second antenna, and held against a rear end of the seal sleeve from being pulled out.

2. The passive RFID-based electronic seal of claim 1, wherein the passive RFID-based electronic seal will not activate until the upper body and the lower body are put together.

3. The passive RFID-based electronic seal of claim 1, wherein the chip is a passive RFID chip.

4. The passive RFID-based electronic seal of claim 3, wherein the RFID chip records data, responds to query, encodes data during transmission and provides digital/analog data conversion.

5. The passive RFID-based electronic seal of claim 1, wherein the socket connects the chip for turning on the chip.

6. The passive RFID-based electronic seal of claim 1, wherein the hole of the seal sleeve is for insertion of the second antenna of the upper sleeve.

7. The passive RFID-based electronic seal of claim 1, when the pawl of the second antenna of the upper sleeve passes through the pawl ring, the upper sleeve and second antenna firmly got stuck in the central sleeve for an aperture of the pawl ring being smaller than that of the pawl of the second antenna.

* * * * *